US006368061B1

(12) United States Patent
Capdevila

(10) Patent No.: US 6,368,061 B1
(45) Date of Patent: Apr. 9, 2002

(54) HIGH EFFICIENCY AND LOW WEIGHT AXIAL FLOW FAN

(75) Inventor: Hugo Capdevila, Stuttgart (DE)

(73) Assignee: Siemens Automotive, Inc., Mississauga, CA (US)

( * ) Notice: Subject to any disclaimer, the term of this patent is extended or adjusted under 35 U.S.C. 154(b) by 0 days.

(21) Appl. No.: 09/564,276

(22) Filed: May 4, 2000

Related U.S. Application Data

(60) Provisional application No. 60/167,964, filed on Nov. 30, 1999.

(51) Int. Cl.[7] ..... F04D 29/38

(52) U.S. Cl. ..... 416/169 A; 416/189; 416/DIG. 5

(58) Field of Search ..... 416/169 A, 189, 416/234, 242, DIG. 2, DIG. 5

(56) References Cited

U.S. PATENT DOCUMENTS

| | | | | |
|---|---|---|---|---|
| 4,566,852 A | | 1/1986 | Hauser | 415/182 |
| 5,326,225 A | * | 7/1994 | Gallivan et al. | 416/179 |
| 5,730,583 A | * | 3/1998 | Alizadeh | 416/189 |
| 5,769,607 A | * | 6/1998 | Neely et al. | 416/189 |
| 5,957,661 A | * | 9/1999 | Hunt et al. | 416/192 |

* cited by examiner

*Primary Examiner*—Edward K. Look
*Assistant Examiner*—Ninh Nguyen

(57) ABSTRACT

A fan includes a hub rotatable about an axis; an annular band concentric with the hub and spaced radially outward from the hub; seven fan blades distributed circumferentially around the hub and extending radially from the hub to the annular band. Each blade has specific parameters defined by:

r, the non-dimensional radius from the rotational axis ($r=R/R_{tip}$ with R being the radius from the rotational axis and $R_{tip}$ being the radius from the rotational axis at the blade tip), ξ, the stagger angle of the blade at the radial distance r, θ, the camber angle of the blade at the radial distance r, σ, the solidity C/S, with C being chord length and S being the circumferential blade spacing at the radial distance r, c, the non-dimensional chord length ($C/R_{tip}$) of the blade at the radial distance r, t, the non-dimensional thickness (T/C where T is the actual thickness at R) of the blade at radius r, Λ, the skew angle of the blade at the radial distance r calculated at 30% chord where the skew at the hub radius is defined as zero skew, and dH/dR, the slope of the dihedral measured at r.

12 Claims, 4 Drawing Sheets

HIGH EFFICIENCY AND LOW WEIGHT AXIAL FLOW FAN

This application is based on and claims the benefit of U.S. Provisional Application No. 60/167,964 filed on Nov. 30, 1999.

FIELD OF THE INVENTION

The invention generally relates to axial flow fans for use in cooling systems. The invention relates particularly to a light-weight and high efficiency axial flow fan.

BACKGROUND OF THE INVENTION

An axial flow fan may be used to produce a flow of cooling air through the heat exchanger components of a vehicle. For example, an airflow generator used in an automotive cooling application may include an axial flow fan for moving cooling air through a liquid-to-air heat exchanger such as an engine radiator, condenser, intercooler, or combination thereof. The required flow rate of air through the fan and change in pressure across the fan vary depending upon the particular cooling application.

To provide adequate cooling, a fan should have performance characteristics which meet the flow rate and pressure rise requirements of the particular automotive application. For example, some applications impose low flow rate and high pressure rise while other applications impose high flow rate and low pressure rise requirements. The fan must also meet the dimensional constraints imposed by the automotive engine environment.

Accordingly, there is a need to provide an improved fan for moving air with high efficiency, low solidity and low weight which has performance characteristics meeting the requirements imposed by various automotive applications.

SUMMARY OF THE INVENTION

An object of the invention is to fulfill the need referred to above. In accordance with the principles of the present invention, this objective is achieved by providing an axial flow fan for producing airflow through an engine compartment of a vehicle. The fan includes a hub rotatable about an axis; an annular band concentric with the hub and spaced radially outward from the hub; seven fan blades distributed circumferentially around the hub and extending radially from the hub to the annular band. Each blade has specific parameters defined by:

- r, the non-dimensional radius from the rotational axis ($r=R/R_{tip}$ with R being the radius from the rotational axis and $R_{tip}$ being the radius from the rotational axis at the blade tip),
- $\xi$, the stagger angle of the blade at the radial distance r,
- $\theta$, the camber angle of the blade at the radial distance r,
- $\sigma$, the solidity C/S, with C being chord length and S being the circumferential blade spacing at the radial distance r,
- c, the non-dimensional chord length ($C/R_{tip}$) of the blade at the radial distance r,
- t, the non-dimensional thickness (T/C where T is the actual thickness at R) of the blade at radius r,
- $\Lambda$, the skew angle of the blade at the radial distance r calculated at 30% chord where the skew at the hub radius is defined as zero skew, and
- dH/dR, the slope of the dihedral measured at r.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

The invention relates to a vehicle cooling system including a heat exchanger, such as an engine coolant radiator or air conditioner heat exchanger, configured to transfer heat from a vehicle system, and a powered fan configured to move air through the heat exchanger. The fan includes fan blades which extend radially and axially and are configured to produce an airflow when rotated about a rotational axis.

Figure 3:
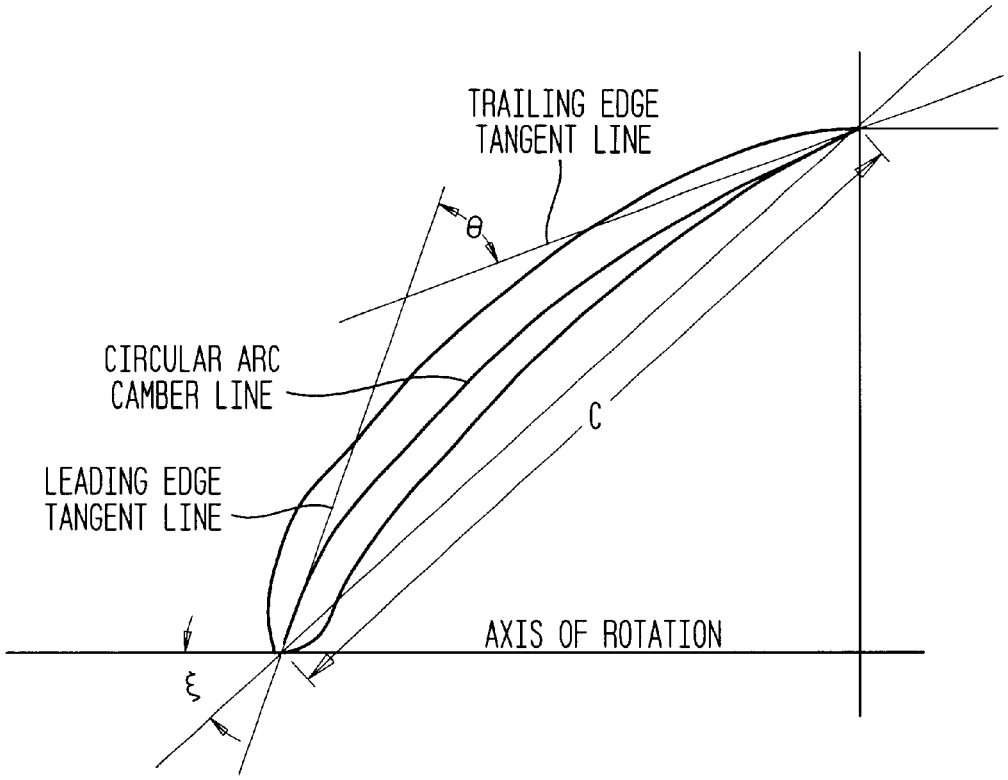
FIG. 3 depicts some of the relationships between and among several of the geometric parameters of the fan of FIGS. 1 and 2.
Figure 4:
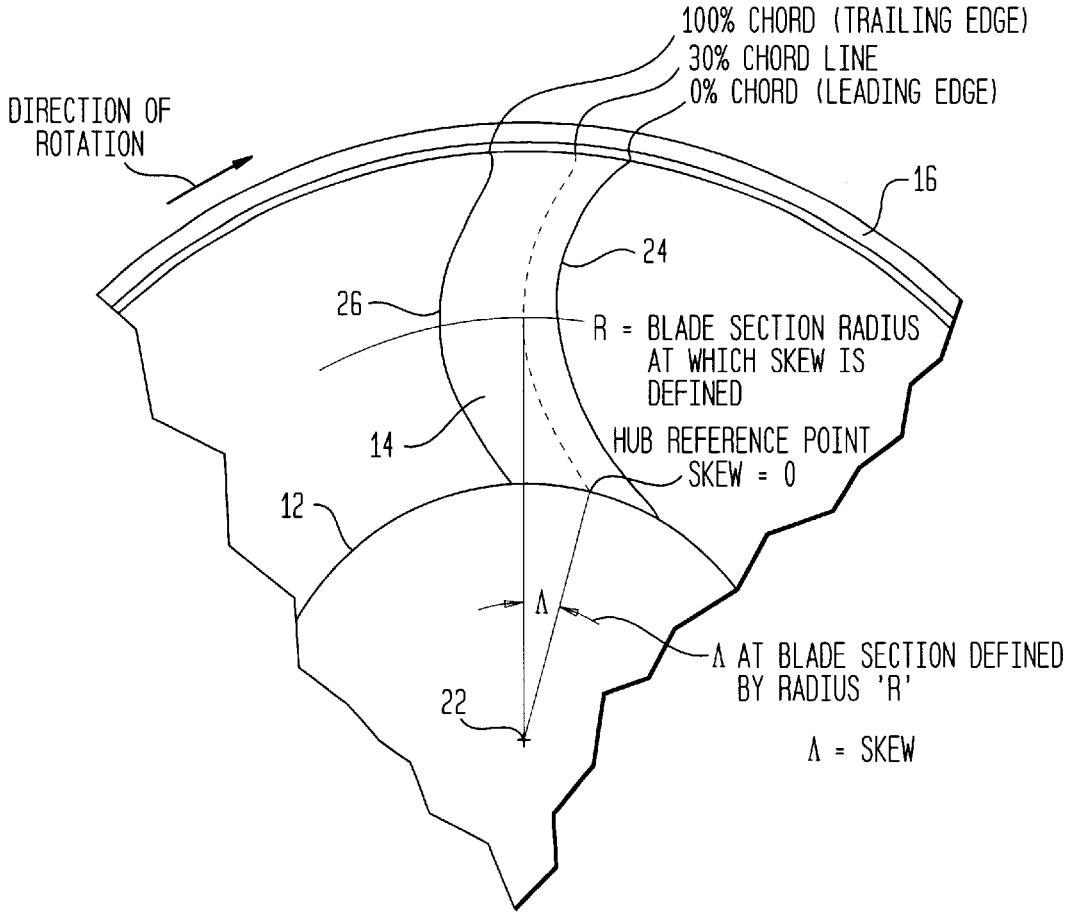
FIG. 4 depicts a portion of a fan and shows how skew is determined.

Fan design terminology used herein will be described with reference to FIGS. 3 and 4. C, chord length, is the length of the shortest line joining the end points of the camber line that lies on the cylinder surface concentric with the axis of rotation and at radius R, the radial distance from the axis of rotation. The values of R in the following tables are indicated by non-dimensional term r. $\xi$ is the stagger angle of a blade section, that is, the angle in degrees between the axis of rotation and the chord line (FIG. 3). The blade is identified as having a leading edge and a trailing edge. The leading edge is the upstream edge of the blade and the trailing edge is the downstream edge of the blade. $\theta$ is the camber angle, that is, the angle in degrees between a tangent to the camber line at the leading edge and a tangent to the camber line at the trailing edge of a blade section at the radial distance R. $\sigma$ is the solidity C/S (where C is chord length and S is the circumferential blade spacing) at the radial distance R.

The reference line for determining the skew angle $\Lambda$ is the radial line through axis of rotation and the 30% chord position at the blade root. The skew is the angle in degrees between this reference line and the line defined as follows. The skew line at radius r is the radial line passing through the axis of rotation and the 30% chord position at the radius r. Note that a negative skew angle indicates forward sweep.

H is the dihedral distance of the trailing edge of a blade, at a radial distance R, from a datum plane perpendicular to the axis of rotation at the downstream surface of the band, and is used to determine the slope, dH/dR, of the dihedral measured at R. Of course, one of ordinary skill in the art will recognize that slope may be measured in other manners, for example, with respect to other datum planes.

Figure 1:
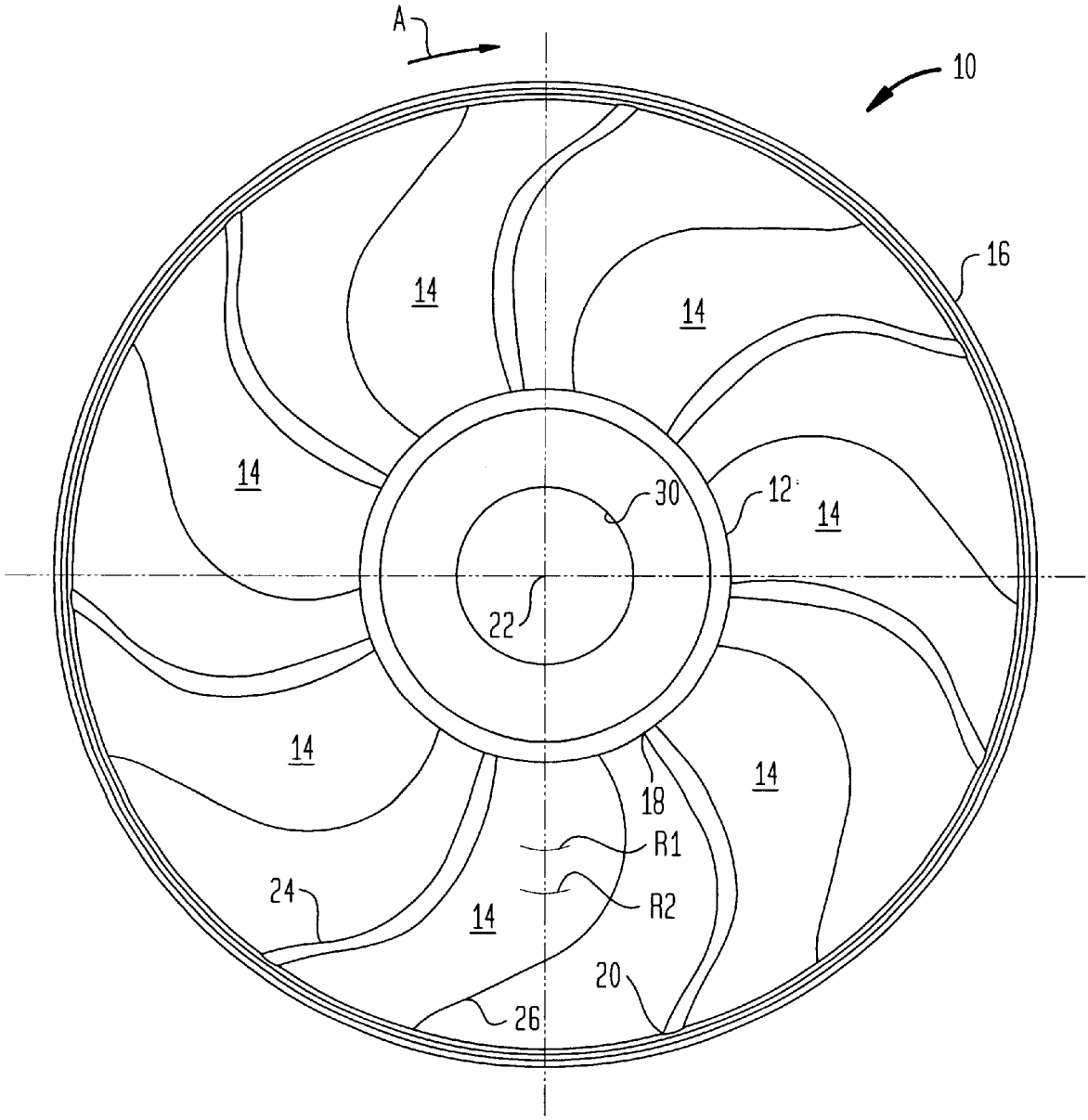
FIG. 1 is a front view of a fan provided in accordance with the invention.
Figure 2:
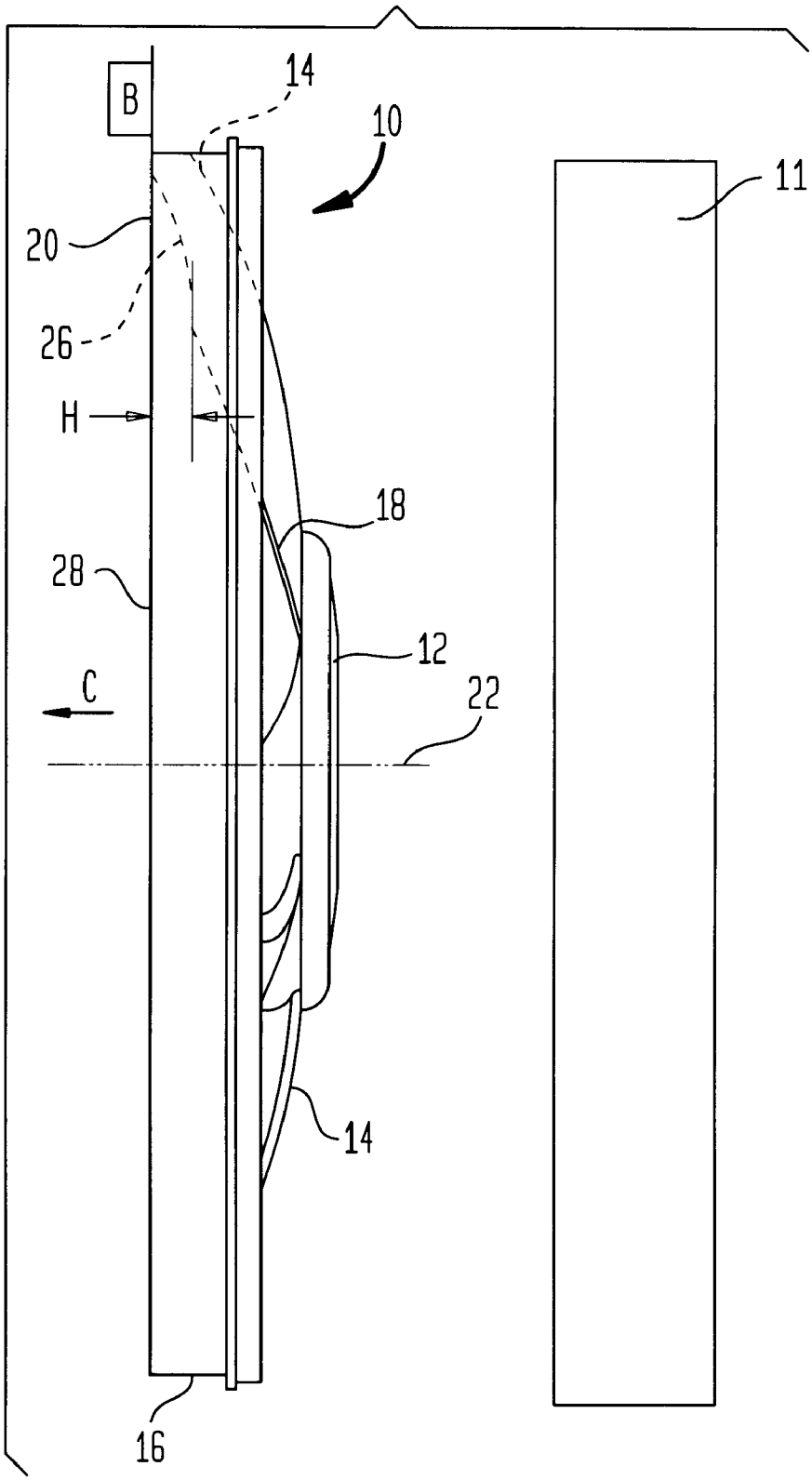
FIG. 2 is a side view of the fan of FIG. 1.

With reference to FIGS. 1 and 2, a fan, generally indicated at 10, is shown in accordance with the principles of the present invention. The fan 10 is constructed and arranged to be mounted adjacent to a heat exchanger 11 as part of a vehicle cooling system. Fan 10 includes an annular hub 12, seven fan blades 14 and a circular band 16. Each fan blade 14 has blade root 18 defined at the hub 12 and a blade tip 20 defined at the band 16. Hub 12 is concentric to a rotational axis 22 (FIG. 2). In the illustrated embodiment, fan blades 14 are distributed circumferentially around hub 12 and are evenly spaced. Blades 14 extend radially from hub 12 to annular band 16, with the distance between the two ends of blades 14 referred to as blade length. The distance from the rotational axis 22 to locations along blades 14 is referred to as blade section radius R. As is shown in FIG. 1, blade section radii R are measured at various distances from axis 22, for example, at R1 and R2. The direction of rotation of the fan 10 is in the direction of arrow A in FIG. 1. Thus, each blade 14 has leading edge 24, a trailing edge 26, and a shape configured to produce an airflow when fan 10 is rotated about rotational axis 22.

An important aspect of the invention pertains to the slope of trailing edge 26 of each blade 14 as each blade extends radially and axially away from fan hub 12. This slope can be expressed relative to a datum plane perpendicular to rotational axis 22. As is shown in FIG. 2, the distance H of trailing edge 26 is measured from datum plane B which is perpendicular to rotational axis 22 through downstream surface 28 of the band 16. Values of H are measured at distances R to determine slope, or dH/dR. As one of skill in the art will recognize, slope can also be measured by other methods.

In general, fan 10 is supported and securely coupled to a shaft (not shown) passing fully or partially through an aperture 30 in the hub 12. Alternatively, the shaft may be securely coupled to fan 10 by other means, such as a screw passing through hub 12 along rotational axis 22 and into the shaft or by a twist-lock or bayonet fitting. The shaft is rotatably driven by a power source (not shown) such as an electric motor or vehicle engine. An appropriate gearing or transmission, such as a belt, chain or direct coupling drive, may couple the power source to the shaft. In the case of an electric motor, the output shaft of the motor may be used also as the shaft for the fan.

As the shaft is rotated about rotational axis 10 by the power source, torque is applied to hub 12, blades 14 and band 16, and fan 10 rotates about rotational axis 22. Upon rotation of fan 10, blades 14 generate an airflow generally in a direction shown by the arrow C in FIG. 2. The airflow may serve to remove heat energy from a liquid, such as a coolant, flowing through heat exchanger. Fan 10 may be located on the upstream or downstream side of a heat exchanger 11 to push or pull air through the heat exchanger depending upon the requirements of the particular configuration.

The components of the invention may be constructed of commonly available materials. By way of example only, fan 10 may be an integrally molded piece fabricated from polycarbonate 20% G.F. Hydex 4320, or from mineral or glass reinforced polyaimide 6/6 (e.g., Du Pont Minlon 22C®), or from other composite or plastics known in the art, or from lightweight metals such as aluminum or titanium.

Each blade has substantially the parameters defined by a particular set of values for R (the radial distance from the rotational axis), C (the chord length of the blade at the radial distance R), ξ (the stagger angle in degrees of a blade section at the radial distance R), θ (the camber angle in degrees of a blade section at the radial distance R), Λ (the skew angle of a blade chord section in degrees, at the radial distance R, calculated at 30% chord, where the skew at the hub radius is defined as zero skew), H (the dihedral distance of the downstream edge of the blade, at the radial distance R, from a plane perpendicular to the axis of rotation at the downstream surface of the band).

The fan 10 was configured to reduce the tonal component of noise at the blade passing frequency while maintaining the flow and pressure generated by the fan.

The Table I below shows ranges of parameters for fan blades of the seven blade fan 10 of FIG. 1 of the invention.

TABLE I

| R | ζ Deg. min | ζ Deg. max | θ Deg. min | θ Deg. max | σ Deg. min | σ Deg. max | c min | c max | t min | t max | Λ Deg. min | Λ Deg. max | dH/dR min | DH/dR max |
|---|---|---|---|---|---|---|---|---|---|---|---|---|---|---|
| 0.38 | 65.39 | 69.39 | 24.55 | 27.13 | 0.725 | 0.886 | 0.248 | 0.303 | 7.20% | 8.80% | −5.00 | 5.00 | | |
| 0.46 | 67.00 | 71.00 | 21.85 | 24.15 | 0.728 | 0.890 | 0.298 | 0.364 | 5.85% | 7.15% | −3.39 | 6.61 | −0.3006 | −0.0006 |
| 0.53 | 68.80 | 72.80 | 18.05 | 19.95 | 0.712 | 0.870 | 0.342 | 0.418 | 4.95% | 6.05% | −3.69 | 6.31 | −0.2569 | 0.0431 |
| 0.61 | 70.00 | 74.00 | 16.63 | 18.38 | 0.663 | 0.810 | 0.365 | 0.447 | 4.50% | 5.50% | −4.09 | 5.91 | −0.2569 | 0.0431 |
| 0.69 | 70.50 | 74.50 | 15.20 | 16.80 | 0.593 | 0.725 | 0.369 | 0.451 | 4.32% | 5.28% | −5.69 | 4.31 | −0.2568 | 0.0432 |
| 0.77 | 70.20 | 74.20 | 13.30 | 14.70 | 0.523 | 0.639 | 0.362 | 0.443 | 4.23% | 5.17% | −8.09 | 1.91 | −0.2570 | 0.0430 |
| 0.85 | 68.50 | 72.50 | 15.49 | 17.12 | 0.440 | 0.538 | 0.336 | 0.411 | 4.28% | 5.23% | −12.59 | −2.59 | −0.2569 | 0.0431 |
| 0.93 | 67.50 | 71.50 | 17.58 | 19.43 | 0.393 | 0.480 | 0.328 | 0.401 | 4.14% | 5.06% | −18.59 | −8.59 | −0.2569 | 0.0431 |
| 1.00 | 68.20 | 72.20 | 18.81 | 20.79 | 0.393 | 0.481 | 0.353 | 0.431 | 3.69% | 4.51% | −22.29 | −12.29 | | |

Wherein:

r is the non-dimensional radius from the rotational axis, ($r=R/R_{tip}$ with R being the radius from the rotational axis and $R_{tip}$ being the radius from the rotational axis at the blade tip), ξ is the stagger angle of the blade at the radial distance r, θ is the camber angle of the blade at the radial distance r, σ is the solidity C/S, with C being chord length and S being the circumferential blade spacing at the radial distance r, c is the non-dimensional chord length ($C/R_{tip}$) of the blade at the radial distance r, t is the non-dimensional thickness of the blade at radius r (T/C where T is the blade thickness at R), Λ is the skew angle of the blade at the radial distance r calculated at 30% chord where the skew at the hub radius is defined as zero skew, and dH/dR is the slope of the dihedral measured at r.

Table II shows parameter values of a specific embodiment of the fan of FIG. 1.

TABLE II

| r — | ζ Deg. | θ Deg. | σ — | c | t % | Λ Deg. | dH/dR |
|---|---|---|---|---|---|---|---|
| 0.38 | 67.39 | 25.84 | 0.81 | 0.275 | 8.00 | 0 | |
| 0.46 | 69.00 | 23.00 | 0.81 | 0.331 | 6.50 | 1.61 | −0.1506 |
| 0.53 | 70.80 | 19.00 | 0.79 | 0.380 | 5.50 | 1.31 | −0.1069 |
| 0.61 | 72.00 | 17.50 | 0.74 | 0.406 | 5.00 | 0.91 | −0.1069 |
| 0.69 | 72.50 | 16.00 | 0.66 | 0.410 | 4.80 | −0.69 | −0.1068 |
| 0.77 | 72.20 | 14.00 | 0.58 | 0.402 | 4.70 | −3.09 | −0.1070 |
| 0.85 | 70.50 | 16.30 | 0.49 | 0.374 | 4.75 | −7.59 | −0.1069 |
| 0.93 | 69.50 | 18.50 | 0.44 | 0.365 | 4.60 | −13.59 | −0.1069 |
| 1.00 | 70.20 | 19.80 | 0.44 | 0.392 | 4.10 | −17.29 | |

Wherein:

r is the non-dimensional radius from the rotational axis, ($r=R/R_{tip}$ with R being the radius from the rotational axis and $R_{tip}$ being the radius from the rotational axis at the blade tip), ξ is the stagger angle of the blade at the radial distance r, θ is the camber angle of the blade at the radial distance r, σ is the solidity C/S, with C being chord length and S being the circumferential blade spacing at the radial distance r, c is the non-dimensional chord length ($C/R_{tip}$) of the blade at the radial distance r, t is the non-dimensional thickness of the blade at radius r (T/C where T is the blade thickness at R), Λ is the skew angle of the blade at the radial distance r calculated at 30% chord where the skew at the hub radius is defined as zero skew, and dH/dR is the slope of the dihedral measured at r.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An axial flow fan for producing airflow through an engine compartment of a vehicle comprising:

a hub rotatable about an axis;

an annular band concentric with the hub and spaced radially outward from the hub;

fan blades distributed circumferentially around the hub and extending radially from the hub to the annular band, wherein each blade has substantially the parameters defined by

| r — | ζ Deg. | θ Deg. | σ — | t % | Λ Deg. | dH/dR |
|---|---|---|---|---|---|---|
| 0.38 | 67.39 | 25.84 | 0.81 | 8.00 | 0 | |
| 0.46 | 69.00 | 23.00 | 0.81 | 6.50 | 1.61 | −0.1506 |
| 0.53 | 70.80 | 19.00 | 0.79 | 5.50 | 1.31 | −0.1069 |
| 0.61 | 72.00 | 17.50 | 0.74 | 5.00 | 0.91 | −0.1069 |
| 0.69 | 72.50 | 16.00 | 0.66 | 4.80 | −0.69 | −0.1068 |
| 0.77 | 72.20 | 14.00 | 0.58 | 4.70 | −3.09 | −0.1070 |
| 0.85 | 70.50 | 16.30 | 0.49 | 4.75 | −7.59 | −0.1069 |
| 0.93 | 69.50 | 18.50 | 0.44 | 4.60 | −13.59 | −0.1069 |
| 1.00 | 70.20 | 19.80 | 0.44 | 4.10 | −17.29 | |

Wherein:

r is the non-dimensional radius from the rotational axis, ($r=R/R_{tip}$ with R being the radius from the rotational axis and $R_{tip}$ being the radius from the rotational axis at the blade tip), ξ is the stagger angle of the blade at the radial distance r, θ is the camber angle of the blade at the radial distance r, σ is the solidity C/S, with C being chord length and S being the circumferential blade spacing at the radial distance r, t is the non-dimensional thickness of the blade at radius r (T/C where T is the blade thickness at R), Λ is the skew angle of the blade at the radial distance r calculated at 30% chord where the skew at the hub radius is defined as zero skew, and dH/dR is the slope of the dihedral measured at r.

2. The fan according to claim 1, wherein said blades are distributed evenly about the hub.

3. The fan according to claim 1, wherein said hub, said blades and said band are made integral.

4. The fan according to claim 1, wherein seven blades are provided.

5. An axial flow fan for producing airflow through an engine compartment of a vehicle comprising:

a hub rotatable about an axis;

an annular band concentric with the hub and spaced radially outward from the hub;

fan blades distributed circumferentially around the hub and extending radially from the hub to the annular band, wherein each blade has substantially the parameters defined by

| r | ζ Deg. min | ζ Deg. max | θ Deg. min | θ Deg. Max | σ Deg. min | σ Deg. max | c min | c max | t min | t max | Λ Deg. min | Λ Deg. max | dH/dR min | DH/dR max |
|---|---|---|---|---|---|---|---|---|---|---|---|---|---|---|
| 0.38 | 65.39 | 69.39 | 24.55 | 27.13 | 0.725 | 0.886 | 0.248 | 0.303 | 7.20% | 8.80% | −5.00 | 5.00 | | |
| 0.46 | 67.00 | 71.00 | 21.85 | 24.15 | 0.728 | 0.890 | 0.298 | 0.364 | 5.85% | 7.15% | −3.39 | 6.61 | −0.3006 | −0.0006 |
| 0.53 | 68.80 | 72.80 | 18.05 | 19.95 | 0.712 | 0.870 | 0.342 | 0.418 | 4.95% | 6.05% | −3.69 | 6.31 | −0.2569 | 0.0431 |
| 0.61 | 70.00 | 74.00 | 16.63 | 18.38 | 0.663 | 0.810 | 0.365 | 0.447 | 4.50% | 5.50% | −4.09 | 5.91 | −0.2569 | 0.0431 |
| 0.69 | 70.50 | 74.50 | 15.20 | 16.80 | 0.593 | 0.725 | 0.369 | 0.451 | 4.32% | 5.28% | −5.69 | 4.31 | −0.2568 | 0.0432 |

-continued

| r | ζ Deg. min | ζ Deg. max | θ Deg. min | θ Deg. Max | σ Deg. min | σ Deg. max | c min | c max | t min | t max | Λ Deg. min | Λ Deg. max | dH/dR min | DH/dR max |
|---|---|---|---|---|---|---|---|---|---|---|---|---|---|---|
| 0.77 | 70.20 | 74.20 | 13.30 | 14.70 | 0.523 | 0.639 | 0.362 | 0.443 | 4.23% | 5.17% | −8.09 | 1.91 | −0.2570 | 0.0430 |
| 0.85 | 68.50 | 72.50 | 15.49 | 17.12 | 0.440 | 0.538 | 0.336 | 0.411 | 4.28% | 5.23% | −12.59 | −2.59 | −0.2569 | 0.0431 |
| 0.93 | 67.50 | 71.50 | 17.58 | 19.43 | 0.393 | 0.480 | 0.328 | 0.401 | 4.14% | 5.06% | −18.59 | −8.59 | −0.2569 | 0.0431 |
| 1.00 | 68.20 | 72.20 | 18.81 | 20.79 | 0.393 | 0.481 | 0.353 | 0.431 | 3.69% | 4.51% | −22.29 | −12.29 | | |

Wherein:

r is the non-dimensional radius from the rotational axis, ($r=R/R_{tip}$ with R being the radius from the rotational axis and $R_{tip}$ being the radius from the rotational axis at the blade tip), ξ is the stagger angle of the blade at the radial distance r, θ is the camber angle of the blade at the radial distance r, σ is the solidity C/S, with C being chord length and S being the circumferential blade spacing at the radial distance r, c is the non-dimensional chord length ($C/R_{tip}$) of the blade at the radial distance r, t is the non-dimensional thickness of the blade at radius r (T/C where T is the blade thickness at R), Λ is the skew angle of the blade at the radial distance r calculated at 30% chord where the skew at the hub radius is defined as zero skew, and dH/dR is the slope of the dihedral measured at r.

6. The fan according to claim 5, wherein said blades are distributed evenly about the hub.

7. The fan according to claim 5, wherein said hub, said blades and said band are made integral.

8. The fan according to claim 5, wherein seven blades are provided.

9. An axial flow fan for producing airflow through an engine compartment of a vehicle comprising:

a hub rotatable about an axis;

an annular band concentric with the hub and spaced radially outward from the hub;

fan blades distributed circumferentially around the hub and extending radially from the hub to the annular band, wherein each blade has substantially the parameters defined by

| r | ζ Deg. min | ζ Deg. Max | θ Deg. Min | θ Deg. Max | σ Deg. min | σ Deg. max | t min | t max | Λ Deg. min | Λ Deg. max | dH/dR max | DH/dR min |
|---|---|---|---|---|---|---|---|---|---|---|---|---|
| 0.38 | 65.39 | 69.39 | 24.55 | 27.13 | 0.725 | 0.886 | 7.20% | 8.80% | −5.00 | 5.00 | | |
| 0.46 | 67.00 | 71.00 | 21.85 | 24.15 | 0.728 | 0.890 | 5.85% | 7.15% | −3.39 | 6.61 | −0.3006 | −0.0006 |
| 0.53 | 68.80 | 72.80 | 18.05 | 19.95 | 0.712 | 0.870 | 4.95% | 6.05% | −3.69 | 6.31 | −0.2569 | 0.0431 |
| 0.61 | 70.00 | 74.00 | 16.63 | 18.38 | 0.663 | 0.810 | 4.50% | 5.50% | −4.09 | 5.91 | −0.2569 | 0.0431 |
| 0.69 | 70.50 | 74.50 | 15.20 | 16.80 | 0.593 | 0.725 | 4.32% | 5.28% | −5.69 | 4.31 | −0.2568 | 0.0432 |
| 0.77 | 70.20 | 74.20 | 13.30 | 14.70 | 0.523 | 0.639 | 4.23% | 5.17% | −8.09 | 1.91 | −0.2570 | 0.0430 |
| 0.85 | 68.50 | 72.50 | 15.49 | 17.12 | 0.440 | 0.538 | 4.28% | 5.23% | −12.59 | −2.59 | −0.2569 | 0.0431 |
| 0.93 | 67.50 | 71.50 | 17.58 | 19.43 | 0.393 | 0.480 | 4.14% | 5.06% | −18.59 | −8.59 | −0.2569 | 0.0431 |
| 1.00 | 68.20 | 72.20 | 18.81 | 20.79 | 0.393 | 0.481 | 3.69% | 4.51% | −22.29 | −12.29 | | |

Wherein:

r is the non-dimensional radius from the rotational axis, ($r=R/R_{tip}$ with R being the radius from the rotational axis and $R_{tip}$ being the radius from the rotational axis at the blade tip), ξ is the stagger angle of the blade at the radial distance r, θ is the camber angle of the blade at the radial distance r, σ is the solidity C/S, with C being chord length and S being the circumferential blade spacing at the radial distance r, t is the non-dimensional thickness of the blade at radius r (T/C where T is the blade thickness at R), Λ is the skew angle of the blade at the radial distance r calculated at 30% chord where the skew at the hut radius is defined as zero skew, and dH/dR is the slope of the dihedral measured at r.

10. The fan according to claim 9, wherein said blades are distributed evenly about the hub.

11. The fan according to claim 9, wherein said hub, said blades and said band are made integral.

12. The fan according to claim 9, wherein seven blades are provided.

* * * * *